US005320426A

United States Patent [19]

Keylon et al.

[11] Patent Number: 5,320,426

[45] Date of Patent: Jun. 14, 1994

[54] ASPHALT DRUM MIXER HAVING TEMPERATURE SENSOR ENCLOSURE

[75] Inventors: Gary Keylon, Plano, Tex.; James G. May, Hixson, Tenn.

[73] Assignee: Astec Industries, Inc., Chattanooga, Tenn.

[21] Appl. No.: 978

[22] Filed: Jan. 6, 1993

[51] Int. Cl.[5] ..... B28C 5/46; F27B 7/42

[52] U.S. Cl. ..... 366/25; 366/140; 366/145; 34/550; 432/111

[58] Field of Search ..... 34/48, 55, 135-137; 366/4, 7, 22-25, 147, 140, 145, 149; 432/103, 106, 108-111, 118

[56] References Cited

U.S. PATENT DOCUMENTS

| | | | |
|---|---|---|---|
| 2,979,951 | 4/1961 | Pircon | 366/145 X |
| 3,013,785 | 12/1961 | King | 34/48 X |
| 3,151,850 | 10/1964 | Wellford, Jr. | 34/48 |
| 3,350,790 | 11/1967 | Whitsel, Jr. | 34/48 X |
| 3,401,923 | 9/1968 | Bearce | 34/48 X |
| 3,598,377 | 8/1971 | Galliers | 366/140 X |
| 3,614,071 | 10/1971 | Brock | 366/25 |
| 3,801,264 | 4/1974 | Lindl | 34/136 X |
| 3,853,305 | 12/1974 | Mize | 366/66 |
| 4,025,057 | 5/1977 | Shearer | 366/25 X |
| 4,048,473 | 9/1977 | Burkhart | 366/145 X |
| 4,190,370 | 2/1980 | Brock et al. | 366/25 |
| 4,867,572 | 9/1989 | Brock et al. | 366/25 |
| 5,052,810 | 10/1991 | Brock | 366/25 |
| 5,083,870 | 1/1992 | Sindelar et al. | 432/110 X |
| 5,090,813 | 2/1992 | McFarland et al. | 366/23 |

FOREIGN PATENT DOCUMENTS

| | | | |
|---|---|---|---|
| 2153103 | 6/1990 | Japan | 366/25 |
| 624088 | 8/1978 | U.S.S.R. | 366/25 |
| 1544857 | 2/1990 | U.S.S.R. | 366/25 |
| 2024027A | 1/1980 | United Kingdom . | |

*Primary Examiner*—Philip R. Coe
*Assistant Examiner*—Charles Cooley
*Attorney, Agent, or Firm*—Nilles & Nilles

[57] ABSTRACT

A drum mixer is useful in the continuous production of asphalt paving composition, and has provision for the accurate control of the final temperature of the composition being produced. The drum mixer comprises a fixedly mounted cylindrical sleeve disposed in a generally horizontal orientation, and rotating blades for conveying the heated aggregate longitudinally through the interior of the sleeve. An opening is provided in the side wall portion of the sleeve, and a box-like enclosure covers the opening and mounts a plurality of sensor mounting tubes, so as to permit one or more sensors to be positioned at a location within the enclosure. The enclosure is located where the blades or mixing action in the sleeve will supply a regular flow of the aggregate into the enclosure, and so that the aggregate then slides over the sensors. The sensors are thus subjected to a representative portion of the aggregate, and they are protected from both the radiant heat of the burner and the physical abuse of the mixing action.

12 Claims, 2 Drawing Sheets

ASPHALT DRUM MIXER HAVING TEMPERATURE SENSOR ENCLOSURE

BACKGROUND OF THE INVENTION

The present invention relates to an asphalt drum mixer of the type employed to continuously heat and dry stone aggregate, while mixing the heated and dried aggregate with liquid asphalt to produce asphalt paving composition.

In one conventional drum mixer of the described type, the aggregate drying and mixing steps are carried out in a rotating drum which is inclined from the horizontal. The virgin aggregate is introduced into the upper end of the drum, and an outlet is provided adjacent the lower end of the drum for withdrawing the heated and dried aggregate. Thus as the drum rotates, the aggregate cascades through the interior of the drum and moves toward the outlet at the lower end. A burner is mounted adjacent one end of the drum so as to create a heated gas stream which moves through the drum, either parallel to or counter to the flow of the moving aggregate. Also, liquid asphalt is commonly introduced into the interior of the drum at a location midway along its length, so that the asphalt becomes mixed with the cascading aggregate and produces a paving composition which exits from the outlet.

With the increased need to control the emissions from such drum mixers, new designs have been developed wherein the virgin aggregate is heated and dried, usually in a drum of the counterflow type, and the heated aggregate is then mixed with liquid asphalt, and possibly also with recycled asphalt pavement (RAP) in a zone of the drum, or a separate device, where it is neither exposed to the hot wet gases nor the radiant energy of the flame used to dry and heat the virgin aggregate. A drum mixer of this type is disclosed in the U.S. Pat. Nos. 4,867,572 and 5,052,810 to Brock. More particularly, in the drum mixer of the Brock patents, a fixed sleeve surrounds the lower portion of the rotating drum so that the heated and dried aggregate is discharged into the annular chamber which is formed between the drum and sleeve. Also, an inlet is provided in the sleeve by which RAP may be introduced into the annular chamber, and another inlet is provided to introduce liquid asphalt into the annular chamber. The drum mounts mixing blades which move through the annular chamber to mix the materials and cause them to move longitudinally to the discharge outlet of the sleeve.

In drum mixers of the type disclosed in the referenced patents to Brock, the temperature of the virgin aggregate must be carefully controlled to ensure a predetermined final temperature of the asphalt composition after the addition of the liquid asphalt and RAP, if used, and under varying operating conditions. For this purpose, it has been conventional to position an infrared sensor or thermocouple through the shell of the mixer near the point where the virgin aggregate enters the annular chamber. The sensor signals the burner to control the flame intensity and thereby maintain the desired temperature of the aggregate.

In has been recognized that the temperature sensor must be shielded from the radiant heat of the burner in order to accurately measure the temperature of the aggregate. Also, the sensor must be exposed to a flow of representative aggregate, yet not be exposed to the full fury of the mixing zone where it can be quickly destroyed by abrasion and the forces imparted by the mixing blades. Heretofore, these requirements have not been fully met.

It is accordingly an object of the present invention to provide a drum mixer of the type which is useful in the continuous production of asphalt paving composition, and which has an inexpensive, reliable temperature sensing device which permits the temperature of the liquid asphalt being produced to be maintained within acceptable limits under varying operating conditions.

It is a further and more particular object of the present invention to provide a drum mixer of the type having an annular mixing chamber wherein stone aggregate is mixed with liquid asphalt, and which includes a reliable temperature measuring device which is protected from the radiant energy of the burner and from physical abuse in the annular mixing chamber, and which is subjected to a representative portion of the aggregate so as to be able to provide an accurate measurement of the temperature of the aggregate in the annular chamber.

SUMMARY OF THE INVENTION

The above and other objects and advantages of the present invention are achieved in the embodiment illustrated herein by the provision of a drum mixer which comprises a fixedly mounted cylindrical sleeve disposed in a generally horizontal orientation and defining opposite side wall portions. The aggregate is heated and conveyed longitudinally through the interior of said sleeve, and means are provided for sensing the temperature of the heated aggregate as it is conveyed through the interior of said sleeve. This sensing means comprises an opening in one of the side wall portions of said sleeve, and a box-like enclosure mounted on the outside of the sleeve so as to cover the opening. The enclosure includes an outer wall, a top wall, and opposite side walls, and the outer wall is disposed generally along a tangent to the one side wall portion of the sleeve when viewed in vertical cross section, and so that a portion of the heated aggregate which is being conveyed through the sleeve is adapted to be conveyed into the enclosure through the opening and then fall by gravity along the outer wall and back through the opening and into the interior of the sleeve. The sensing means further includes sensor mounting means for mounting at least one temperature sensor within the enclosure so as to sense the temperature of the aggregate which is conveyed into and then falls from the enclosure.

In the preferred embodiment of the invention, the means for heating the aggregate comprises an elongate hollow drum disposed coaxially within the sleeve so as to define an annular mixing chamber between the drum and sleeve. The drum is mounted for rotation about its axis, and the common axis of the drum and sleeve is inclined somewhat from the horizontal. Aggregate is adapted to enter the upper end of the drum, and upon rotation of the drum, the aggregate moves in a cascading fashion toward the lower end of the drum where it drops into the annular mixing chamber. A burner is disposed adjacent the lower end of the drum, so that the aggregate moving through the drum moves counter to the direction of gas flow through the drum. The sleeve has a lower end which overlies the lower outlet end of the drum, and mixing blades are mounted to the exterior of the drum so as to be positioned within the annular chamber for mixing the aggregate received therein upon rotation of the drum and moving the aggregate toward the discharge opening of the sleeve, and while continuously conveying a representative portion of the moving aggregate into the enclosure where its temperature may be sensed.

BRIEF DESCRIPTION OF THE DRAWINGS

Some of the objects and advantages of the present invention having been stated, others will appear as the description proceeds, when taken in conjunction with the accompanying schematic drawings in which.

DETAILED DESCRIPTION OF THE PREFERRED EMBODIMENT

Figure 1:
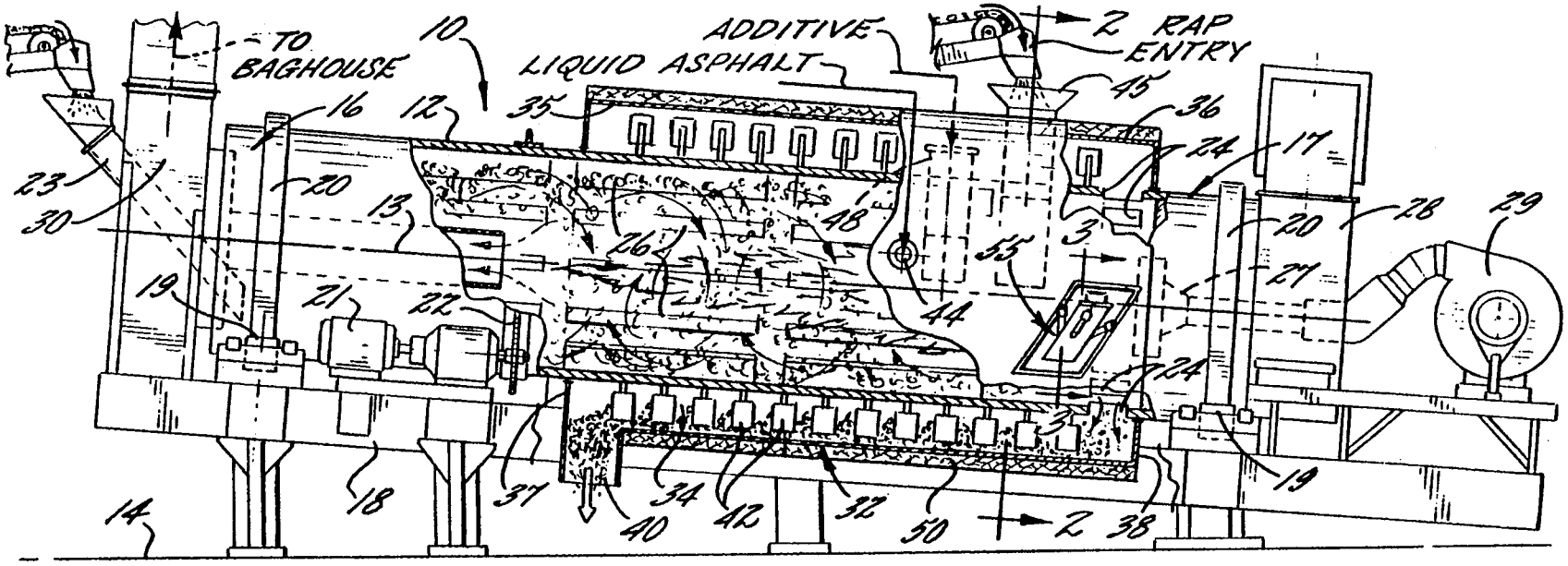
FIG. 1 is a partially sectioned side elevation view of a drum mixer which embodies the features of the present invention.

Referring more particularly to the drawings, FIG. 1 illustrates a drum mixer 10 in accordance with one preferred embodiment of the present invention. The mixer comprises an elongate hollow drum 12 defining a central axis 13, and with the drum being mounted for rotation about the central axis. The central axis is inclined with respect to the horizontal 14 so as to define an upper end 16 and a lower end 17 of the drum.

The drum 12 is rotatably mounted on a frame 18 by means of bearings 19 mounted to the frame Which engage races 20 which are mounted about the circumference of the drum. A motor 21 rotatably drives the drum by engagement with a circumferential gear 22, and as further illustrated in the above noted patents to Brock, the disclosures of which are incorporated herein by reference. An aggregate inlet chute 23 is positioned adjacent the upper end of the drum for introducing stone aggregate or the like into the interior of the drum. The inlet chute 23 is preferably provided with an air sealing flop gate (not shown) of conventional design. Also, a plurality of outlet openings 24 are formed about the periphery of the drum at the lower end thereof for withdrawing the heated aggregate from the interior of the drum in the manner further described below.

A plurality of flights or vanes 26 are mounted on the inside of the drum, for lifting the aggregate and dropping the same through the interior of the mixer as it is rotated. The flights 26 may be of different configurations in different portions of the drum, as is conventional. Thus the aggregate which is introduced into the drum via the inlet chute 23 is caused to cascade through the interior of the drum, and move toward the outlet openings 24, as the drum rotates.

The drum mixer 10 further includes a burner 27 which is mounted in an enclosure 28 at the lower end of the drum for directing a high temperature flame into the interior of the drum. The burner 27 is of conventional design, and it includes a blower 29 which charges a mixture of fuel and air into the burner, where it is ignited to produce a flame for heating the interior of the drum. The enclosure 28 may include mufflers of conventional design to provide relatively quiet operation. An exhaust duct 30 is positioned at the upper end of the drum, which may include an exhaust fan (not shown) for exhausting the heated gas from the drum and so that the heated gas flows through the drum to heat the cascading aggregate. The exhaust air flow is ducted to a conventional filtering baghouse or other dust collector.

The drum mixer 10 further comprises a fixed sleeve 32 which is mounted coaxially about a portion of the length of the drum 12 adjacent the lower end 17 thereof, and so that the drum and sleeve define an annular chamber 34 therebetween. The sleeve 32 is thus similarly inclined to the horizontal, so as to define an upper end 35 and a lower end 36. The sleeve also includes annular shoulders 37, 38 at each end thereof to close the annular chamber 34 between the drum and the sleeve, and the lower end 36 of the sleeve 32 overlies the outlet openings 24 of the drum 12 so that the outlet openings 24 open into the annular chamber 34. Thus the heated and dried aggregate in the lower end of the drum falls into the annular chamber during rotation of the drum. The sleeve 32 further includes a discharge opening 40 adjacent the upper end thereof, which preferably also includes an air sealing flop gate (not shown).

A plurality of paddle like flights or mixing blades 42 are mounted on the outer circumference of the drum 12 along the portion of the drum received within the sleeve 32. The blades 42 are configured and angled such that as the blades traverse the annular chamber 34, they engage the aggregate in the annular chamber and move the aggregate toward the discharge opening 40 of the sleeve, while causing the aggregate to be mixed.

Figure 2:
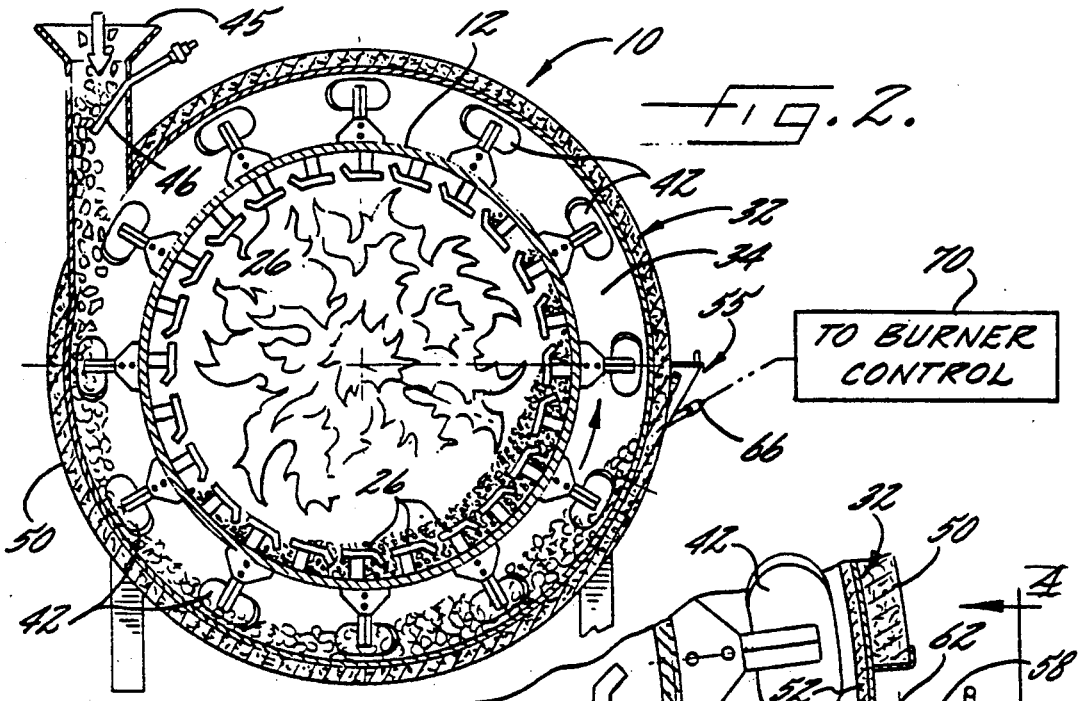
FIG. 2 is a sectional view taken substantially along the line 2—2 in FIG. 1.

A liquid asphalt supply pipe 44 (FIG. 1) communicates with the annular chamber 34 for introducing liquid asphalt into the chamber so as to be mixed with the aggregate therein. Further, an inlet 45 positioned adjacent the lower end of the sleeve permits an additive, such as recyclable asphalt pavement, to be introduced into the annular chamber and so as to be mixed with the aggregate and the liquid asphalt therein. The inlet 45 includes an air sealing flop gate 46 as seen in FIG. 2. The resulting asphalt paving composition is discharged through the discharge opening 40 of the sleeve.

Figure 3:
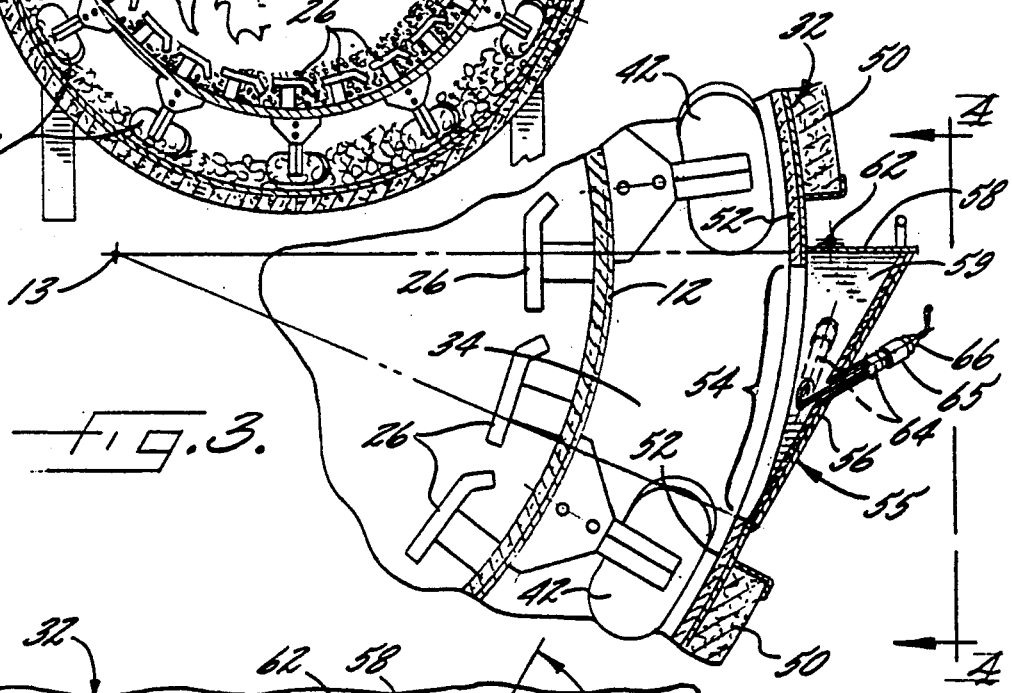
FIG. 3 is a fragmentary sectional view taken substantially along the line 3—3 of FIG. 1.

In the illustrated embodiment, a further inlet 48 is provided intermediate the length of the sleeve for permitting another additive, such as lime, to be introduced into the annular chamber, and so as to be mixed with the other materials in the chamber. Also, the outer sleeve of the drum mixer is insulated by a layer of fiberglass insulation 50, and the inside surface of the sleeve is preferably covered by a protective lining material 52, as best seen in FIG. 3.

Figure 4:
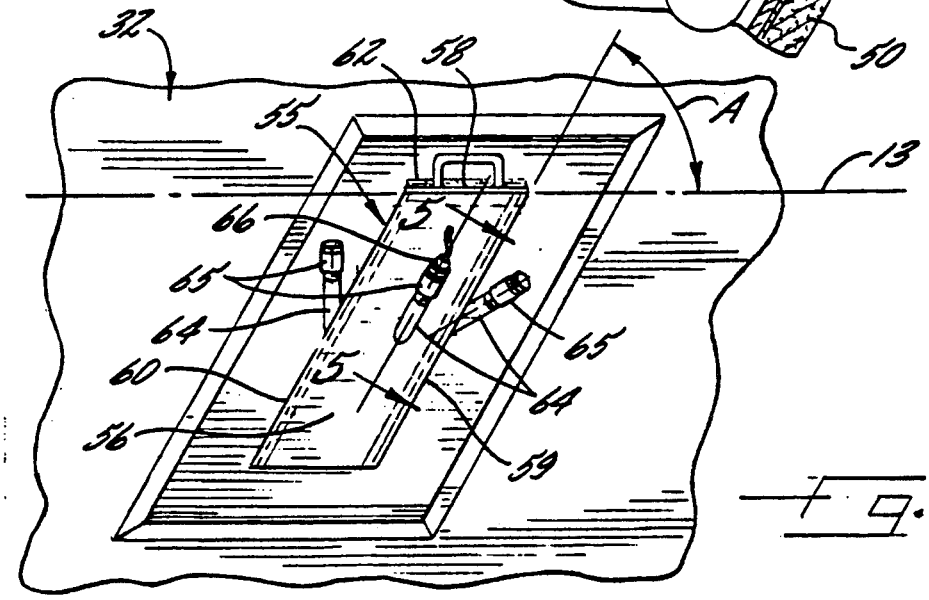
FIG. 4 is a fragmentary side elevation view of the side wall portion of the sleeve and the enclosure as shown in FIG. 1.

In accordance with the present invention, means are provided for sensing the temperature of the heated aggregate as it is conveyed through the annular chamber 34. The sensing means comprises an opening 54 (FIG. 3) in one of the side wall portions of the sleeve, and a box-like enclosure 55 is mounted on the outside of the sleeve so as to cover the opening 54. More particularly, the enclosure 55 includes an outer wall 56, a top wall 5B, and opposite side walls 59, 60. The outer wall 56 is disposed generally along a tangent to the side wall portion of the sleeve when viewed in vertical cross-section (i.e., FIG. 3) and so that a portion of the heated aggregate which is being conveyed through the annular chamber 34 by the blades 42 is adapted to be conveyed into the enclosure 55 through the opening 54, and then fall by gravity along the outer wall 56 and back through the opening 54 and into the interior of the annular chamber 34. The top wall 58 of the enclosure is mounted to the sleeve by means of a hinge 62, to facilitate access to the interior of the enclosure. Also, in the illustrated embodiment, the top wall 58 lies in a plane which includes the central axis 13, and the opposite side walls 59, 60 lie in parallel planes which are each inclined at an angle A of about 60° from the central axis 13 when viewed in side elevation (note FIG. 4).

Figure 6:
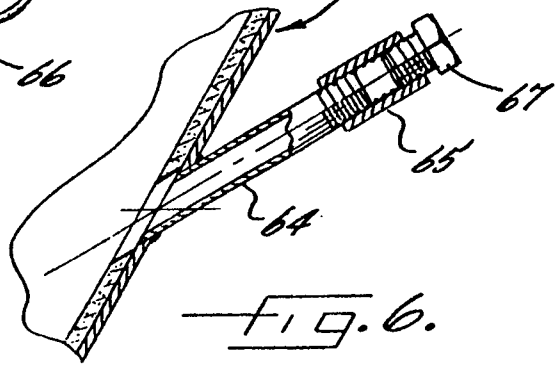
FIG. 6 is a view similar to FIG. 5 but illustrating the sensor removed from the mounting tube.
Figure 5:
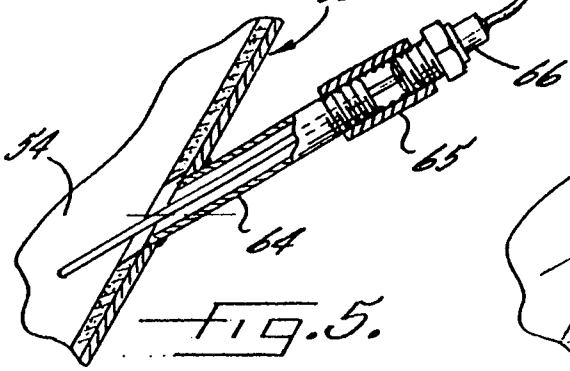
FIG. 5 is a fragmentary sectional view taken substantially along the line 5—5 of FIG. 4, with the temperature sensor positioned so as to be mounted within the enclosure.

Each of the outer wall 56, and opposite sides 59, 60, mount a sensor mounting tube 64 for mounting one or more temperature sensors within the enclosure. Each tube 64 in turn mounts an internally threaded sleeve 65, for receiving either the sensor 66 as seen in FIG. 5, or a closure plug 67 as seen in FIG. 6. By this arrangement, one, two, or three temperature sensors 66 may be positioned to extend through respective tubes 64 and be positioned at a location within the enclosure so as to sense the temperature of the aggregate which enters and then falls from the enclosure.

In operation, the aggregate is continuously introduced through the inlet chute 23 into the upper end 16 of the rotating drum 12, and so that the aggregate cascades through the interior of the drum and moves toward the outlet openings 24 at the lower end 17. Also, with the burner 27 in operation, heated gasses flow through the length of the drum and exhaust through the outlet duct 30 to a filtering baghouse or the like.

The heated aggregate falls through the openings 24 at the lower end of the drum and into the annular chamber 34 defined by the sleeve 32. RAP may if desired be introduced into the annular chamber through the inlet 45, which is downstream of the opening 54 in the side wall portion of the sleeve, and liquid asphalt is introduced into the annular chamber at the supply pipe 44 which is located downstream of the inlet 45 at which the RAP is introduced. The rotating blades 42 engage the aggregate as it falls into the annular chamber through the openings 24, and convey it toward the discharge opening 40, while mixing the aggregate with the liquid asphalt and RAP, if used.

As will be appreciated, the rotation of the blades 42 causes a portion of the aggregate to be continuously thrown through the opening 54 and into the enclosure 55. Upon being received in the enclosure 55, the aggregate falls by gravity along the outer wall 56 and past the temperature sensors 66, and back into the annular chamber 34. Since the blades 42 also move the aggregate longitudinally, fresh samples of the aggregate are continuously thrown into the enclosure 55, to thereby continuously provide a representative sample to the sensors 66.

The output signals of the sensors 66 are fed to a burner computer control as illustrated schematically at 70 in FIG. 2, for controlling the flame intensity of the burner 27 and so as to permit the temperature of the aggregate to be closely controlled under varying operating conditions. More particularly, the final temperature of the asphalt composition being produced is established, and checked by a temperature sensor (not shown) mounted in the discharge opening 40. The computer control 70 can determine the required temperature for the virgin aggregate based on the desired final temperature and the heat lost or absorbed by the RAP. Any deviation in temperature can be quickly corrected by adjusting the intensity of the burner 27, due to its close proximity to the measuring point.

In the drawings and specification, there has been set forth a preferred embodiment of the invention. However, it will be understood that the features and advantages of the present invention are applicable to other mixing apparatus, such as pugmills of the type commonly used to mix asphalt and aggregate compositions and as disclosed for example in U.S. Pat. No. 3,853,305 to Mize. Also, although specific terms are employed in the present specification, they are used in a generic and descriptive sense only and not for purposes of limitation.

That which is claimed is:

1. A drum mixer adapted for heating and drying an aggregate, and comprising a fixedly mounted cylindrical sleeve disposed in a generally horizontal orientation and defining opposite side wall portions, means for conveying heated aggregate longitudinally through the interior of said sleeve, and means for sensing the temperature of the heated aggregate as it is conveyed through the interior of said sleeve, said sensing means comprising (a) an opening in one of said side wall portions of said sleeve, (b) a box-like enclosure mounted on the outside of said sleeve so as to cover said opening, with said enclosure including an outer wall, a top wall, and opposite side walls, and with said outer wall disposed generally along a tangent to said one side wall portion of said sleeve when viewed in vertical cross section and so that a portion of the heated aggregate which is being conveyed through said sleeve is adapted to be conveyed into said enclosure through said opening and then fall by gravity along said outer wall and back through said opening and into the interior of said sleeve, (c) a temperature sensor for sensing the temperature of the aggregate which is conveyed into and then falls from said enclosure, and (d) sensor mounting means for mounting said temperature sensor within said enclosure.

2. The drum mixer as defined in claim 1 wherein said sensor mounting means comprises at least one mounting tube extending through one of said walls of said enclosure so as to permit said temperature sensor to extend through said tube and into said enclosure.

3. The drum mixer as defined in claim 1 further comprising means for heating said aggregate and means for delivering said aggregate into the interior of said sleeve.

4. The drum mixer as defined in claim 3 further comprising means for controlling said heating means in response to the temperature sensed by said sensor to permit the temperature of the aggregate to be closely controlled.

5. The drum mixer as defined in claim 4 further comprising means for introducing liquid asphalt into the interior of said sleeve at a location downstream of said opening and so that the liquid asphalt is mixed with the heated aggregate being conveyed therethrough.

6. A drum mixer useful in the continuous production of asphalt paving composition, and comprising an elongate hollow drum defining a central axis, means mounting said drum for rotation about said central axis and with said central axis being inclined with respect to the horizontal so as to define an upper end and a lower end of said drum, aggregate inlet means positioned adjacent said upper end of said drum for introducing aggregate into the interior of said drum, aggregate outlet means positioned adjacent said lower end of said drum for withdrawing aggregate from the interior of said drum, means for rotating said drum about said central axis so as to cause the aggregate which is introduced at said inlet means to cascade through the interior of said drum and move to said outlet means, heating means positioned adjacent said lower end of said drum for introducing heated gas into the interior of said drum, exhaust duct means positioned adjacent said upper end of said drum for exhausting the heated gas therefrom and so that the heated gas flows through said drum and through the cascading aggregate, a fixed sleeve mounted coaxially about a portion of the length of said drum adjacent said lower end thereof and so as to define an annular chamber between said drum and said sleeve, said sleeve having a lower end overlying said outlet means of said drum and an upper end positioned intermediate said ends of said drum with said outlet means of said drum opening into said annular chamber so as to receive the heated and dried aggregate therein, and with said sleeve further including opposite side wall portions and a discharge opening adjacent said upper end thereof, mixing vane means mounted to the exterior of said drum so as to be positioned within said annular chamber for mixing the aggregate received therein upon rotation of said drum and moving the aggregate toward said discharge opening of said sleeve, means for sensing the temperature of the heated aggregate as it is conveyed through said annular chamber, said sensing means comprising (a) an opening in one of said side wall portions of said sleeve, (b) a box-like enclosure mounted on the outside of said sleeve so as to cover said opening, with said enclosure including an outer wall, a top wall, and opposite side walls, and with said outer wall disposed generally along a tangent to said one side wall portion of said sleeve when viewed in vertical cross section and so that a portion of the heated aggregate which is being conveyed through said annular chamber is adapted to be conveyed into said enclosure through said opening and then fall by gravity along said outer wall and back through said opening and into the interior of said annular chamber, (c) a temperature sensor for sensing the temperature of the aggregate which is conveyed into and then falls from said enclosure, and (d) sensor mounting means for mounting said temperature sensor within said enclosure.

7. The drum mixer as defined in claim 6 further comprising means for controlling said heating means in response to the temperature sensed by said sensor to permit the temperature of the aggregate to be closely controlled.

8. The drum mixer as defined in claim 7 further comprising means for introducing liquid asphalt into said annular chamber at a location downstream of said opening and so that the liquid asphalt is mixed with the heated aggregate being conveyed therethrough.

9. The drum mixer as defined in claim 8 further comprising means positioned adjacent said lower end of said sleeve for introducing an additive into said annular chamber so as to be mixed with the aggregate and the liquid asphalt therein.

10. The drum mixer as defined in claim 8 wherein said top wall of said enclosure is hingedly mounted to said sleeve to facilitate access to the interior of the enclosure.

11. The drum mixer as defined in claim 8 wherein said sensor mounting means includes a plurality of sensor mounting tubes which extend through one of said walls of said enclosure to permit a plurality of said temperature sensors to be positioned in said enclosure.

12. The drum mixer as defined in claim 8 wherein said top wall of said enclosure lies in a plane which includes said central axis, and said opposite side walls of said enclosure lie in parallel planes which are each inclined at an angle of about 60 degrees from said central axis when viewed in side elevation.

* * * * *